US008403432B2

(12) United States Patent
Chen et al.

(10) Patent No.: US 8,403,432 B2
(45) Date of Patent: Mar. 26, 2013

(54) LATCH AND RELEASE DEVICE FOR SLIDE ASSEMBLY

(75) Inventors: Ken-Ching Chen, Kaohsiung Hsien (TW); Chien-Li Huang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 155 days.

(21) Appl. No.: 12/889,884

(22) Filed: Sep. 24, 2010

(65) Prior Publication Data

US 2012/0076446 A1 Mar. 29, 2012

(51) Int. Cl.
*A47B 95/00* (2006.01)

(52) U.S. Cl. ..... 312/333; 312/334.46

(58) Field of Classification Search ..... 312/333, 312/334.1, 334.7, 334.8, 334.44, 334.45, 312/334.46, 334.47, 319.1, 332.1, 265.4; 384/21

See application file for complete search history.

(56) References Cited

U.S. PATENT DOCUMENTS

| | | | | |
|---|---|---|---|---|
| 4,605,265 | A * | 8/1986 | Bessinger et al. | 384/20 |
| 4,979,909 | A * | 12/1990 | Andrews | 439/352 |
| 5,033,805 | A * | 7/1991 | Hobbs | 312/334.11 |
| 5,262,923 | A * | 11/1993 | Batta et al. | 361/679.37 |
| 6,145,944 | A * | 11/2000 | Bayani et al. | 312/334.44 |
| 6,997,611 | B2 * | 2/2006 | Chen et al. | 384/21 |
| 7,281,694 | B2 * | 10/2007 | Allen et al. | 248/244 |
| 7,364,244 | B2 | 4/2008 | Sandoval | |
| 7,552,899 | B2 * | 6/2009 | Chen et al. | 248/224.8 |
| 7,604,308 | B2 | 10/2009 | Tseng et al. | |
| 7,744,177 | B2 * | 6/2010 | Peng et al. | 312/334.4 |
| 2004/0056572 | A1 * | 3/2004 | Chen et al. | 312/333 |
| 2008/0122333 | A1 * | 5/2008 | Tseng et al. | 312/333 |

* cited by examiner

*Primary Examiner* — Janet M Wilkens
*Assistant Examiner* — Matthew Ing
(74) *Attorney, Agent, or Firm* — Rosenberg, Klein & Lee

(57) ABSTRACT

A latch and release device for a slide assembly includes first and second rails slidably movable relative to each other. An engaging member includes a resilient arm and an engaging portion is connected to the resilient arm and faces the first rail. The engaging portion can be engaged with a latch which is fixed to the second rail to restrict the second rail to move relative to the first rail. An operation member includes a first end, a second end and a body which is pivotably connected to the second rail and the first end of the operation member contacts the resilient arm. When the second end of the operation member is shifted, the resilient arm is moved by the first end of the operation member to disengage from the latch.

3 Claims, 9 Drawing Sheets

LATCH AND RELEASE DEVICE FOR SLIDE ASSEMBLY

FIELD OF THE INVENTION

The present invention relates to a latch and release device for a slide assembly, and more particularly, to a latch and release device which is easily operated and can securely lock to the slide assembly.

BACKGROUND OF THE INVENTION

U.S. Pat. No. 7,604,308 B2 to Tseng discloses a latch and release device for a slide assembly, which discloses a resilient catch, a press button, and a mounting base. The resilient catch has a first end and a second end opposite to each other and a locking portion. The first end of the resilient catch is fixed to the slide assembly. The locking portion prevents the slide assembly from extending. The press button has a locating hole. The mounting base has a chamber to receive the press button and allow the press button to slide therein. The mounting base has an opening corresponding in position to the locating hole of the press button for the second end of the resilient catch to penetrate through the opening and to be secured in the locating hole of the press button.

U.S. Pat. No. 7,364,244 to Sandoval discloses a user-controllable latching carrier rail system, which discloses a movable latching member 212A as shown in FIG. 3B and the movable latching member has a distal portion 310A fixed to a slide rail 302A, an intermediate portion 310B which is located at an angle with respect to the distal portion, a proximal portion 310C extending from the intermediate portion, and a handle 204 extending from the proximal portion. Wherein, the proximal portion has a protrusion 308 which controls the handle by the user to deform the intermediate portion and the proximal portion relative to the slide rail. The protrusion is then disengaged from the locked status.

The two prior patents require the user to apply a significant force directly against the force from the latching member or the resilient catch, and this needs to be improved.

In addition, the latching member or the resilient catch relies on the firm connection relationship between the two locked parts to ensure that the locked status does not fail.

SUMMARY OF THE INVENTION

The present invention intends to provide a latch and release device for a slide assembly, wherein the operation is easy and requires less force, and the locked status is secured and reliable.

According to one aspect of the present invention, there is provided a latch and release device for a slide assembly which includes a first rail and a second rail longitudinally and slidably movable relative to the first rail. The latch and release device is connected to the second rail and comprises an engaging member fixed to the second rail and the engaging member has a resilient arm and at least one engaging portion is connected to the resilient arm. The at least one engaging portion faces the first rail. An operation member has a first end, a second end and a body which is connected to the first and second ends. The body is pivotably connected to the second rail and the first end of the operation member contacts the resilient arm. When the second end of the operation member is shifted, the resilient arm is moved by the first end of the operation member.

Preferably, the engaging portion extends from the resilient arm and has an inclined surface and a vertical surface which extends from the inclined surface.

Preferably, the device further comprises an attachment member fixed to the second rail. The attachment member has a pivotal portion including a pivot pin and an opening adjacent to the pivotal portion. The body of the operation member is inserted through the opening of the attachment member and pivotably connected to the pivotal portion of the attachment member by the pivot pin.

Preferably, the attachment member extends from an end of the second rail.

Preferably, the device further comprises a handle fixed to the second end of the operation member.

Preferably, the device further comprises a bracket fixed to the first rail. The bracket includes a latch which is engaged with the engaging portion of the engaging member when the second rail is retracted relative to the first rail.

According to another aspect of the present invention, there is provided a slide assembly which comprises a first rail and a second rail which is longitudinally and slidably movable relative to the first rail. The second rail includes a top flange, a bottom flange and a connection wall which is connected between the top and bottom flanges. A bracket is fixed to the first rail. An engaging member is fixed to the second rail and has a resilient arm and at least one engaging portion connected to the resilient arm. The at least one engaging portion faces the bracket. An attachment member is fixed to the second rail and has a pivotal portion including a pivot pin and an opening adjacent to the pivotal portion. An operation member is pivotably connected to the pivotal portion of the attachment member by the pivot pin. The operation member has a first end, a second end and a body which is connected to the first and second ends. The body is inserted through the opening of the attachment member. The first end of the operation member contacts the resilient arm and the second end of the operation member extends out from the opening of the attachment member.

The bracket includes a latch which is engaged with the engaging portion of the resilient arm when the second rail is retracted relative to the first rail.

The engaging portion extends from the resilient arm and has an inclined surface and a vertical surface which extends from the inclined surface.

The attachment member has two wings extending over the top and bottom flanges respectively and the bracket has two reception portions and each reception portion has a first wall and a second wall which extends from an end of the first wall and is connected to the bracket. The first wall and the second wall define a passage which is located corresponding to the two wings.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
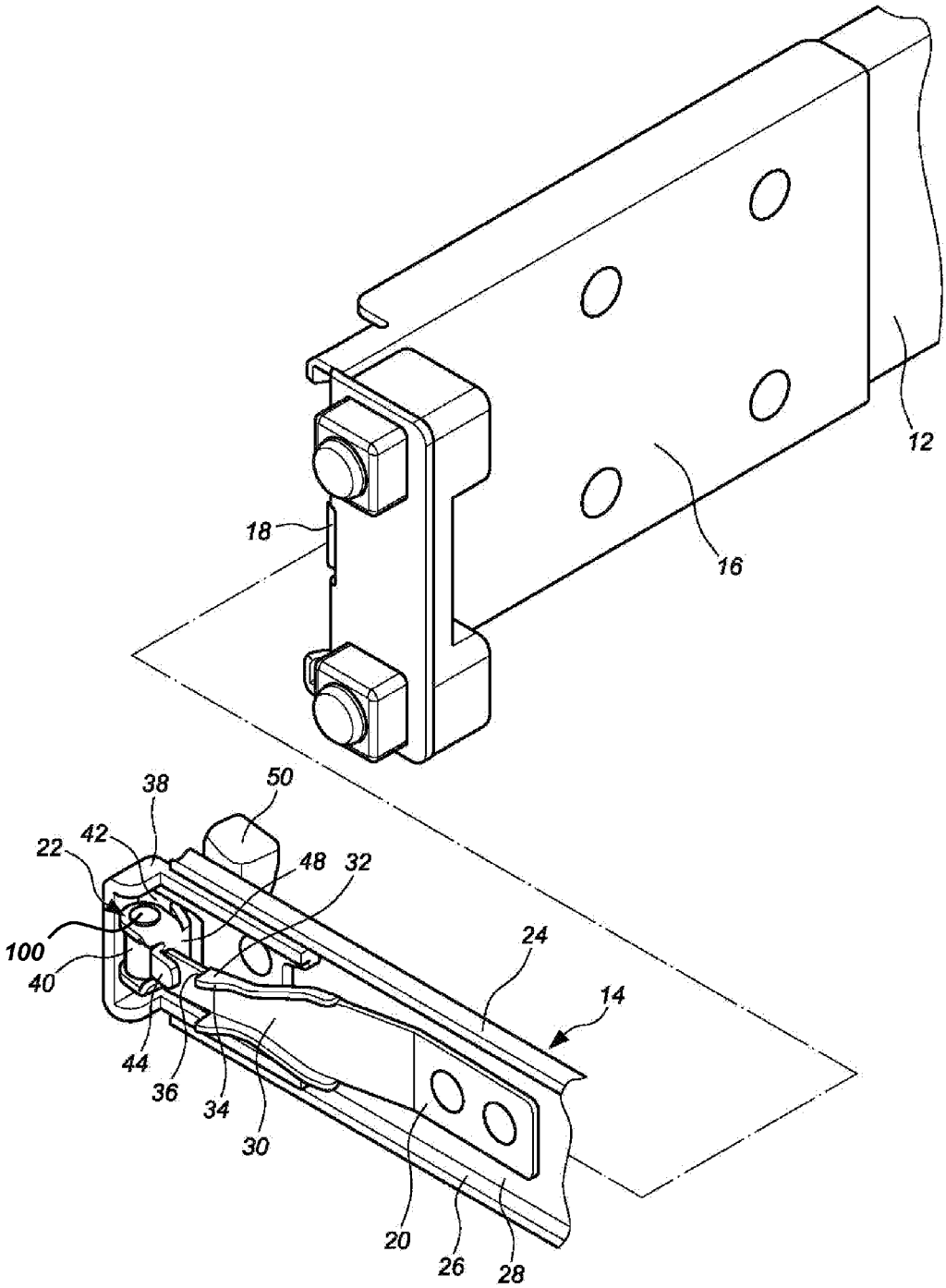
FIG. 1 is an exploded view to show the latch and release device of the first embodiment of the present invention.
Figure 2:
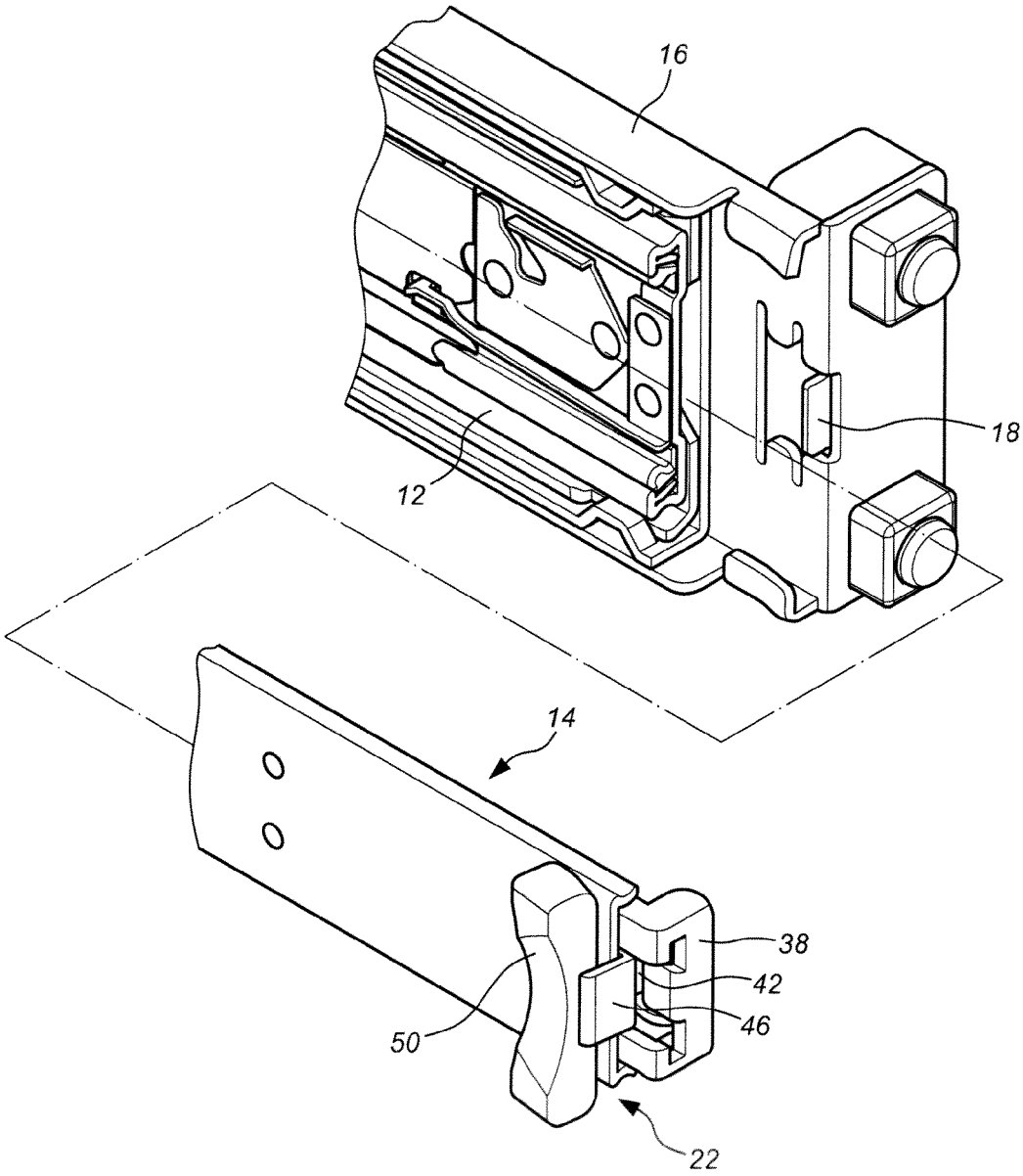
FIG. 2 is another exploded view to show the latch and release device of the first embodiment of the present invention.

Referring to FIGS. 1 and 2, the latch and release device for a slide assembly of the present invention comprises a first rail 12 and a second rail 14 which is longitudinally and slidably movable relative to the first rail 12. A bracket 16 is fixed to the first rail 12 and a latch 18 is connected to the bracket 16. An engaging member 20 is fixed to the second rail 14 and an operation member 22 is pivotably connected to the second rail 14.

The second rail 14 includes a top flange 24, a bottom flange 26 and a connection wall 28 which is connected between the top and bottom flanges 24, 26.

The engaging member 20 comprises a resilient arm 30 and at least one engaging portion 32 connected to the resilient arm 30, wherein the engaging portion 32 can face the first rail 12 or the bracket 16 when the second rail 14 is moved relative to the first rail 12. In this embodiment, two engaging portions 32 extend from two sides of the resilient arm 30 and each engaging portion 32 has an inclined surface 34 and a vertical surface 36 which extends from the inclined surface 34. An attachment member 38 is fixed to the second rail 14 and has a pivotal portion 40 including a pivot pin 100 and an opening 42 adjacent to the pivotal portion 40.

The operation member 22 has a first end 44, a second end 46 and a body 48 which is connected to the first and second ends 44, 46. The body 48 is pivotably connected to the pivotal portion 40 of the attachment member 38 of the second rail 14 by the pivot pin 100 and the body 48 is inserted through the opening 42 of the attachment member 38. The first end 44 contacts the resilient arm 30. The second end 46 extends out from the opening 42 of the attachment member 38. When the second end 46 of the operation member 22 is shifted, the first end 44 is pivoted about the body 48 so as to contact the resilient arm 30 which is moved relative to the second rail 14.

In this embodiment, a handle 50 is fixed to the second end 46 of the operation member 22 and the user can shift the operation member 22 by fingers.

Figure 3:
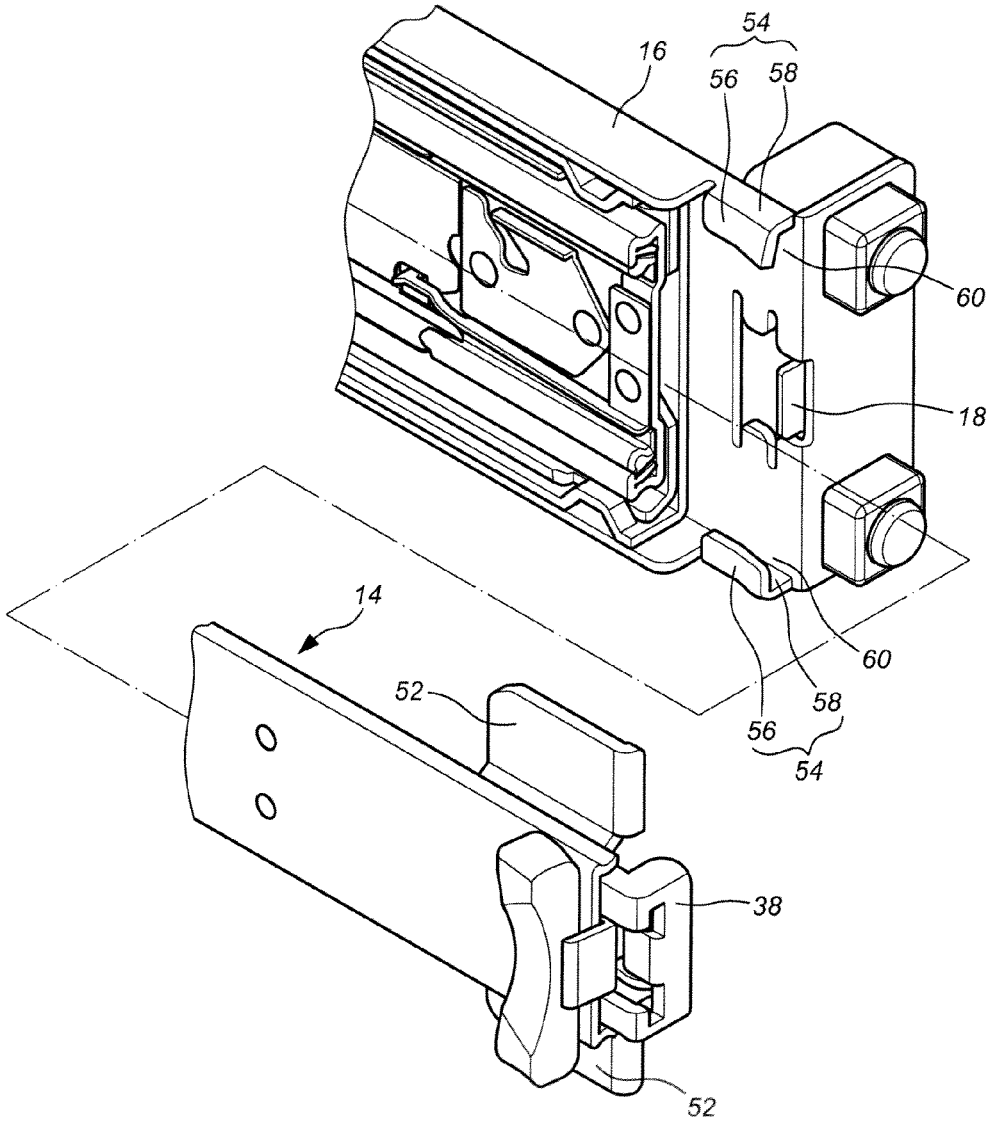
FIG. 3 is yet another exploded view to show the latch and release device of the first embodiment of the present invention wherein wings and reception portion are disclosed.
Figure 4:
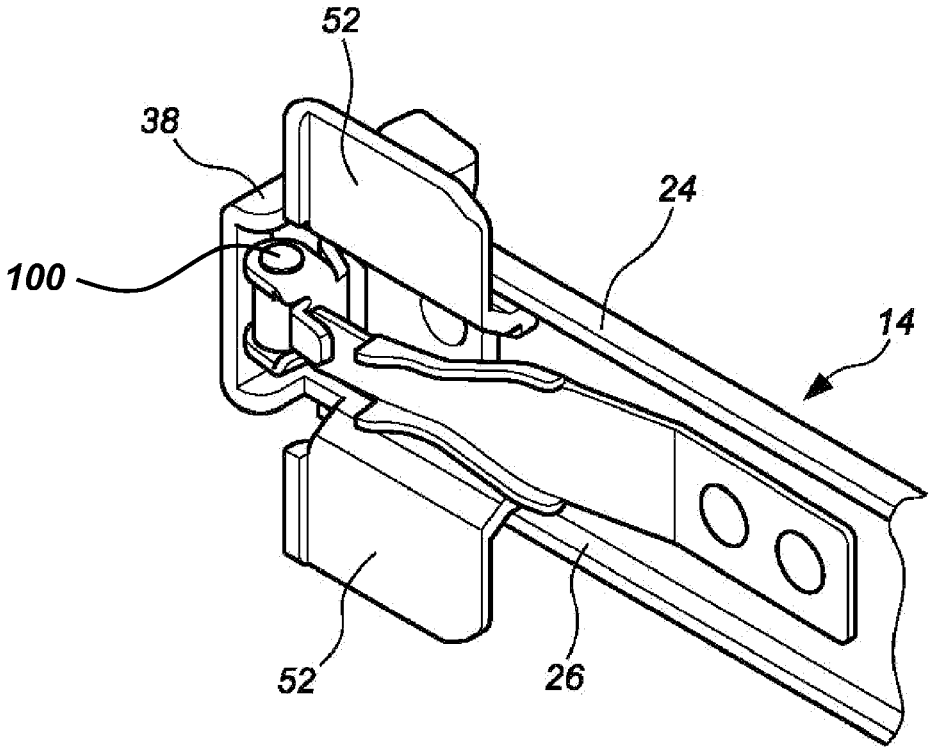
FIG. 4 is a perspective view to show the second rail with the attachment member and two wings.

As shown in FIGS. 3 and 4, the attachment member 38 includes two wings 52 extending over the top and bottom flanges 24, 26 of the second rail 14. The bracket 16 includes has two reception portions 54 and each reception portion 54 has a first wall 56 and a second wall 58 which extends from an end of the first wall 56 and is connected to the bracket 16. The first wall 56 and the second wall 58 define a passage 60 which is located corresponding to the two wings 52. The wings 52 are located in the passage 60 to restrict the movement of the wings 52.

Figure 5:
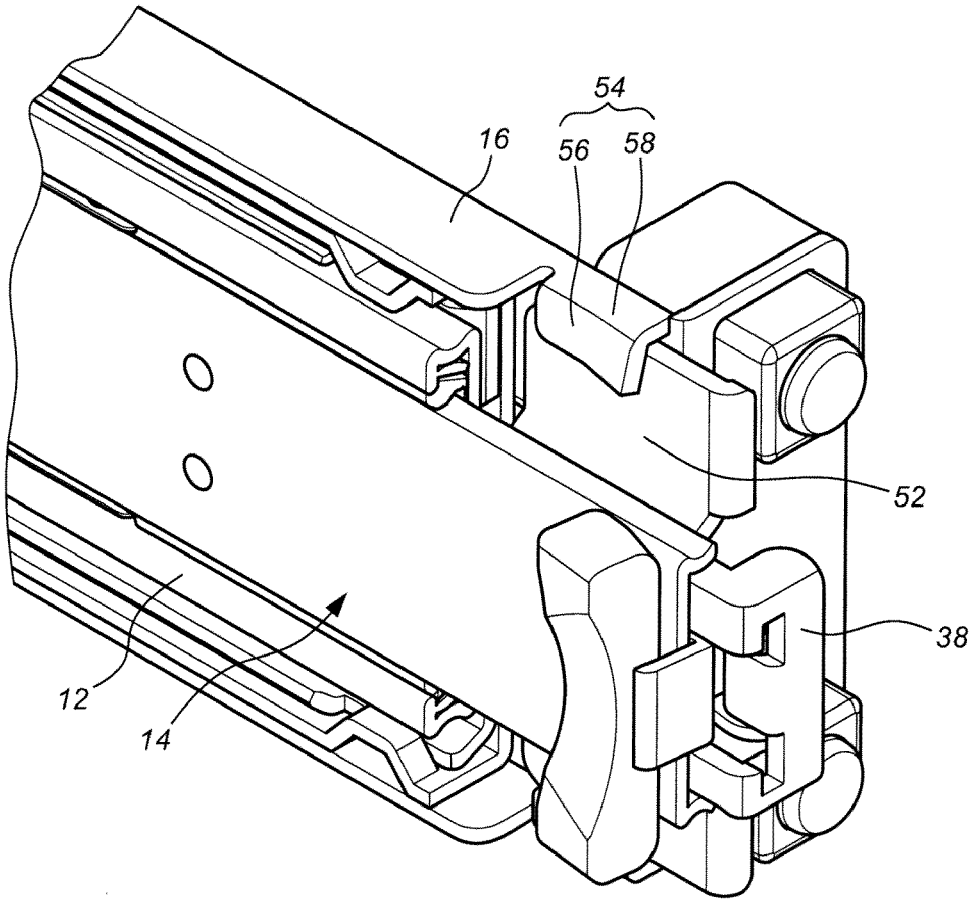
FIG. 5 shows that the slide assembly is in a retracted status.
Figure 6:
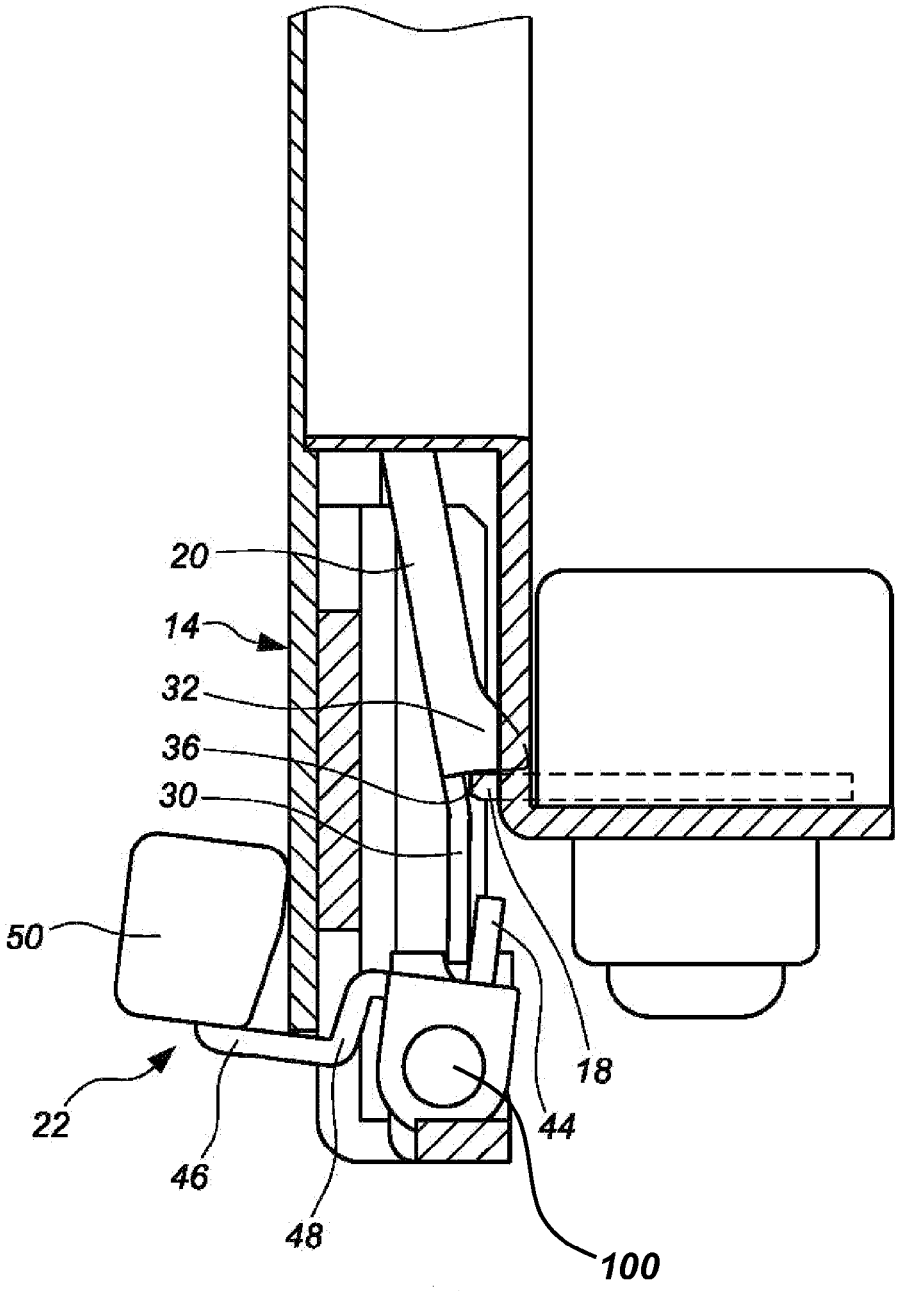
FIG. 6 is a partial cross sectional view to show the locked status of the slide assembly.

FIGS. 5 and 6 show that the second rail 14 is retracted relative to the first rail 12, wherein the wings 52 of the attachment member 38 are located in the reception portions 54 of the bracket 16 to restrict the transverse movement of the second rail 14 relative to the first rail 12 to ensure the stability of the retracted status. In addition, the vertical surface 36 of the engaging portion 32 of the engaging member 20 contacts the latch 18 of the bracket 16 so as to be connected to each other to make the second rail 14 be positioned at the retracted status relative to the first rail 12.

Figure 7:
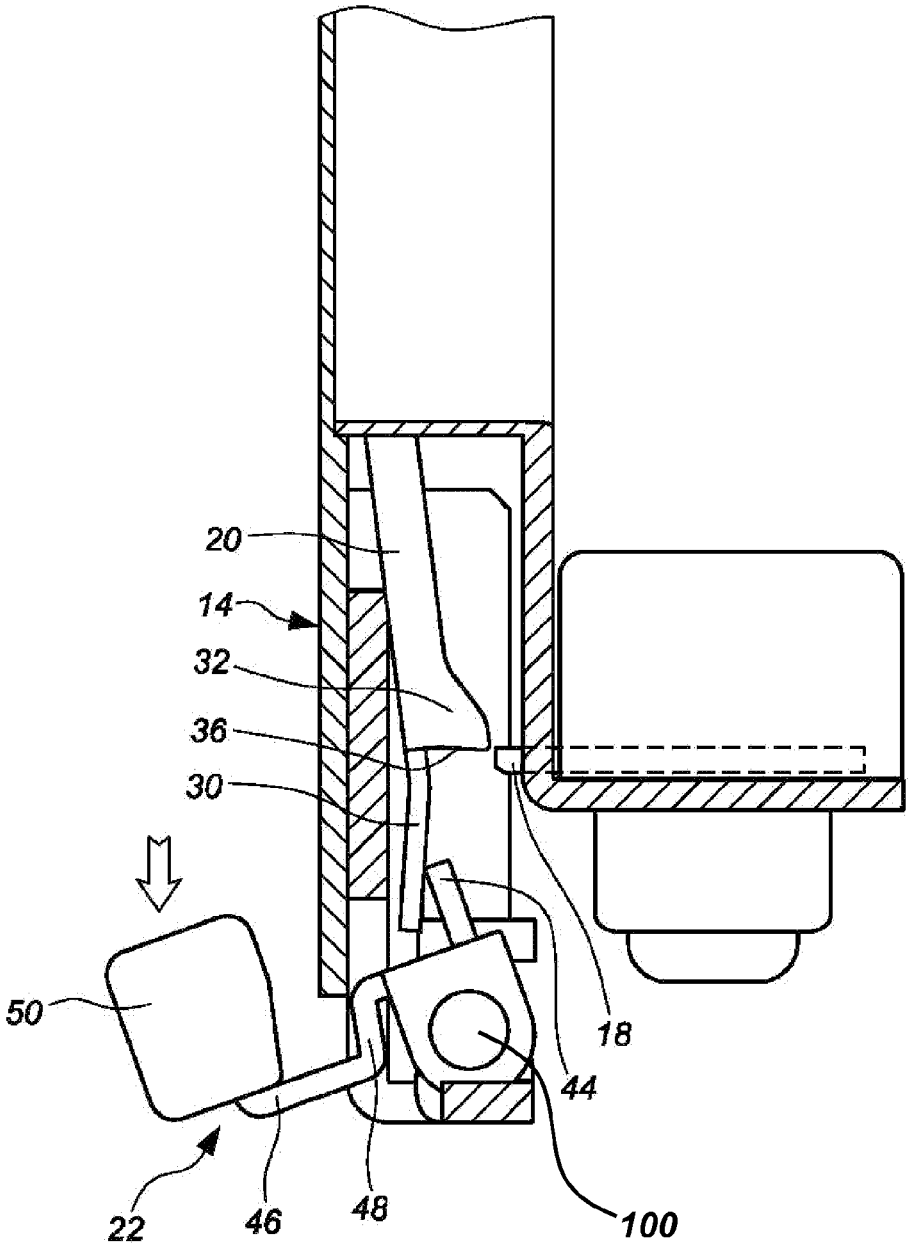
FIG. 7 is a partial cross sectional view to show the unlocked status of the slide assembly.

FIG. 7 shows that when the second end 46 of the operation member 22 is shifted, the operation member 22 is pivoted about the pivot pin 100 of pivotal portion 40 and the first end 44 contacts the resilient arm 30 to allow the resilient arm 30 to move relative to the second rail 14 such that the vertical surface 36 of the engaging portion 32 is disengaged from the latch 18 and the second rail 14 can be pulled out. By the arrangement, the operation of the latch and release device requires less force.

Figure 8:
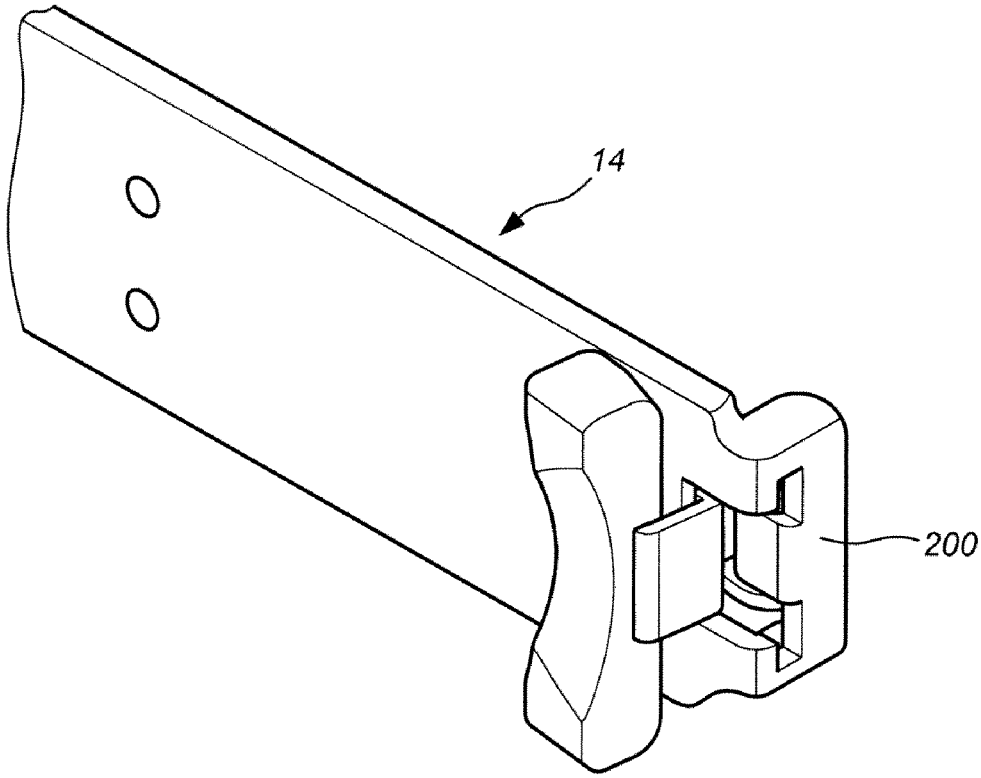
FIG. 8 is a perspective view to show the second rail of the second embodiment of the present invention.

FIG. 8 shows another embodiment, wherein the attachment member 200 integrally extends from an end of the second rail 14.

Figure 9:
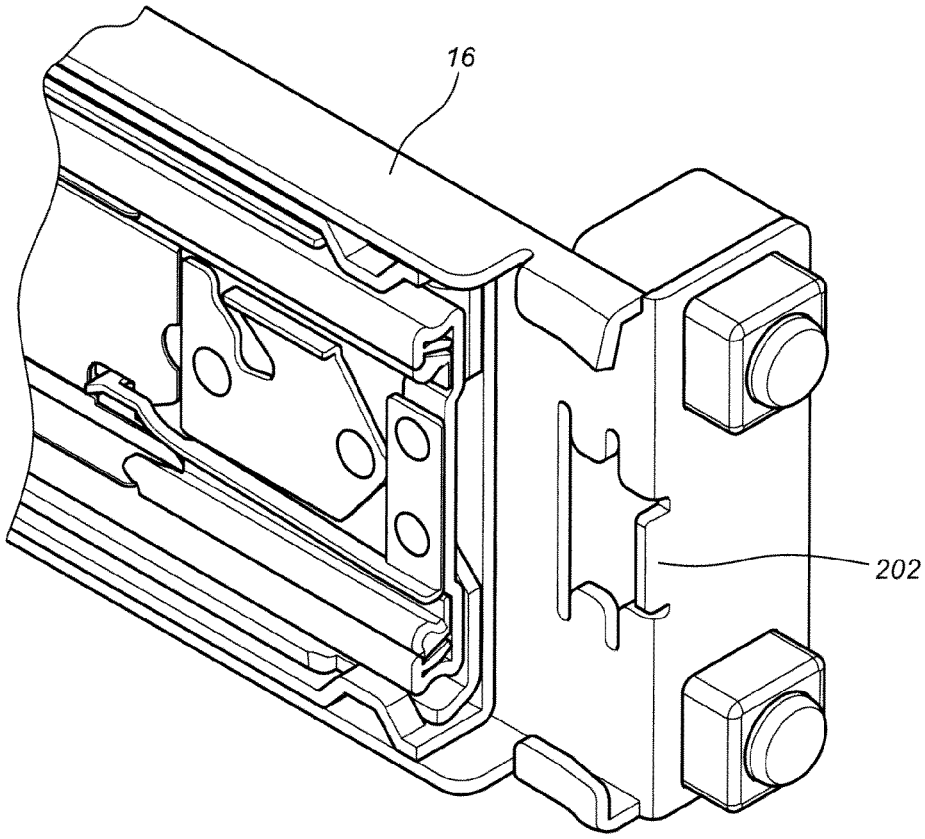
FIG. 9 shows that the latch is connected to the bracket in the second embodiment of the present invention.

FIG. 9 shows yet another embodiment of the present invention wherein the latch 202 integrally extends from the bracket 16.

While we have shown and described the embodiment in accordance with the present invention, it should be clear to those skilled in the art that further embodiments may be made without departing from the scope of the present invention.

What is claimed is:

1. A slide assembly comprising:

a first rail;

a second rail longitudinally and slidably movable relative to the first rail, the second rail includes a top flange, a bottom flange and a connection wall which is connected between the top and bottom flanges;

a bracket fixed to the first rail;

an engaging member fixed to the second rail and having a resilient arm and at least one engaging portion connected to the resilient arm, the at least one engaging portion facing the bracket;

an attachment member fixed to the second rail and having a pivotal portion capturing a pivot pin and an opening defined adjacent to the pivotal portion, the attachment member includes two wings extending over the top and bottom flanges respectively, the bracket includes two reception portions, each reception portion including a first wall and a second wall which extends from an end of the first wall and is connected to the bracket, the first wall and the second wall define a passage which is located corresponding to the two wings, and an operation member pivotally connected to and cooperatively captured by the pivotal portion and the pivot pin disposed in the pivotal portion of the attachment member, the operation member having a first end, a second end and a body which is connected to the first and second ends, the body inserted through the opening of the attachment member, the first end of the operation member rotationally contacting the resilient arm for rotationally actuating the resilient arm by rotation of the operation member about the pivot pin responsive to a torque applied to the second end of the operation member, the second end of the operation member extending out from the opening of the attachment member.

2. The slide assembly as claimed in claim 1, wherein the bracket includes a latch which is engaged with the engaging portion disposed on the resilient arm when the second rail is retracted relative to the first rail.

3. The slide assembly as claimed in claim 1, wherein the engaging portion extends from the resilient arm and has an inclined surface and a vertical surface which extends from the inclined surface.

* * * * *